US011114046B2

(12) United States Patent
Sun et al.

(10) Patent No.: US 11,114,046 B2
(45) Date of Patent: Sep. 7, 2021

(54) DISPLAY DEVICE AND METHOD FOR DRIVING THE SAME, DRIVING APPARATUS, AND COMPUTER-READABLE MEDIUM

(71) Applicants: Beijing BOE Optoelectronics Technology Co., Ltd., Beijing (CN); BOE TECHNOLOGY GROUP CO., LTD., Beijing (CN)

(72) Inventors: Yilang Sun, Beijing (CN); Yifang Chu, Beijing (CN); Zhihua Ji, Beijing (CN); Tiankuo Shi, Beijing (CN); Lingyun Shi, Beijing (CN); Xiaomang Zhang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/635,086

(22) PCT Filed: Jul. 25, 2019

(86) PCT No.: PCT/CN2019/097721
§ 371 (c)(1),
(2) Date: Jan. 29, 2020

(87) PCT Pub. No.: WO2020/063078
PCT Pub. Date: Apr. 2, 2020

(65) Prior Publication Data

US 2021/0020116 A1 Jan. 21, 2021

(30) Foreign Application Priority Data

Sep. 27, 2018 (CN) ..... 201811129308.0

(51) Int. Cl.
*G09G 3/34* (2006.01)

(52) U.S. Cl.
CPC ... *G09G 3/3406* (2013.01); *G09G 2320/0646* (2013.01); *G09G 2330/021* (2013.01)

(58) Field of Classification Search
None
See application file for complete search history.

(56) References Cited

U.S. PATENT DOCUMENTS 9,711,093 B2 7/2017 Fujiwara et al.
9,741,305 B2 * 8/2017 Jung ..... G09G 3/3406
(Continued)

FOREIGN PATENT DOCUMENTS

CN 102324222 A 1/2012
CN 102770798 A 11/2012
(Continued)

*Primary Examiner* — Dorothy Harris
(74) *Attorney, Agent, or Firm* — Westman, Champlin & Koehler, P.A.

(57) ABSTRACT

The present disclosure relates to a method for driving a display device, a driving apparatus, a display device and a computer-readable medium. The method includes: determining backlight signal values of backlight partitions in a backlight module according to input grayscale values of pixels; adjusting the backlight signal values of the backlight partitions by performing peak stretching processing on the backlight partitions in the condition that a total power consumption of the adjusted backlight module is less than a power threshold of the backlight module; determining backlight signal values of the pixels; determining output grayscale values of the pixels according to the backlight signal values of the pixels and the input grayscale values of the pixels; driving a display panel to display an image according to the output grayscale values of the pixels; and driving the
(Continued)

backlight module according to the adjusted backlight signal values of the backlight partitions.

17 Claims, 9 Drawing Sheets

(56) References Cited

U.S. PATENT DOCUMENTS

| | | | | |
|---|---|---|---|---|
| 10,210,822 | B2 | 2/2019 | Zhang et al. | |
| 10,388,231 | B2 | 8/2019 | Zhou et al. | |
| 2003/0090455 | A1* | 5/2003 | Daly | G09G 3/3426 345/102 |
| 2006/0238487 | A1* | 10/2006 | Shih | G09G 3/342 345/102 |
| 2006/0279522 | A1* | 12/2006 | Kurihara | G09G 3/3426 345/102 |
| 2007/0152926 | A1* | 7/2007 | Kwon | G09G 3/3426 345/82 |
| 2008/0252666 | A1* | 10/2008 | Chen | G09G 3/2044 345/690 |
| 2012/0299891 | A1 | 11/2012 | Fujiwara et al. | |
| 2016/0203774 | A1 | 7/2016 | Ahn et al. | |
| 2018/0075813 | A1 | 3/2018 | Zhang et al. | |
| 2018/0218690 | A1 | 8/2018 | Zhou et al. | |
| 2019/0355313 | A1 | 11/2019 | Sun et al. | |

FOREIGN PATENT DOCUMENTS

| | | | |
|---|---|---|---|
| CN | 106023905 | A | 10/2016 |
| CN | 106297674 | A | 1/2017 |
| CN | 106448571 | A | 2/2017 |
| CN | 108665857 | A | 10/2018 |
| KR | 20130030877 | A | 3/2013 |
| KR | 20130052298 | A | 5/2013 |

* cited by examiner

DISPLAY DEVICE AND METHOD FOR DRIVING THE SAME, DRIVING APPARATUS, AND COMPUTER-READABLE MEDIUM

CROSS-REFERENCE TO RELATED APPLICATION(S)

This application is a Section 371 National Stage Application of International Application No. PCT/CN2019/097721, filed Jul. 25, 2019, which has not yet published, and claims priority to the Chinese Patent Application No. 201811129308.0, filed on Sep. 27, 2018, which is incorporated herein by reference in their entireties.

TECHNICAL FIELD

The present disclosure relates to the field of display technology, and more particularly, to a display device and a method for driving the same, a driving apparatus, and a computer-readable medium.

BACKGROUND

A display device such as a liquid crystal display etc. may be controlled using a local backlight adjustment (i.e., local dimming) method, so as to reduce power consumption of the display device, increase a contrast of a display picture, and reduce afterimages, etc. This local backlight adjustment method is to divide a backlight source of the display device into a plurality of backlight partitions, and then control the respective backlight partitions independently. Peak driving technology may also be used in combination with the method. That is, peak driving is performed on some of the backlight partitions, so that these backlight partitions reach possible maximum brightness.

However, in a realization process, compensation for transmittance of a Liquid Crystal Display (LCD) panel does not match with a change in backlight, which causes a "bright block phenomenon" of the display and affects a display effect.

SUMMARY

Embodiments of the present disclosure propose a display device and a method for driving the same, a driving apparatus, and a computer-readable medium.

According to an aspect of the present disclosure, there is proposed a method for driving a display device comprising a display panel and a backlight module, the method comprising:

determining backlight signal values of a plurality of backlight partitions in the backlight module according to input grayscale values of pixels in an image to be displayed;

adjusting the backlight signal values of the plurality of backlight partitions by performing peak stretching processing on at least one of the plurality of backlight partitions having a backlight signal value greater than a peak stretching threshold, so that a total power consumption of the plurality of backlight partitions in the backlight module is less than a power threshold of the backlight module;

determining backlight signal values of the pixels in the image to be displayed according to the adjusted backlight signal values of the plurality of backlight partitions;

determining output grayscale values of the pixels according to the backlight signal values of the pixels and the input grayscale values of the pixels;

driving the display panel to display the image to be displayed using the determined output grayscale values of the pixels; and driving the backlight module using the adjusted backlight signal values of the plurality of backlight partitions.

In an example, the adjusting the backlight signal values of the plurality of backlight partitions by performing peak stretching processing on at least one backlight partition having a backlight signal value greater than a peak stretching threshold comprises:

determining a maximum power consumption margin of the backlight module according to the backlight signal values of the plurality of backlight partitions and the power threshold of the backlight module;

calculating, for each of the plurality of backlight partitions, a representative backlight value of the backlight partition based on a cumulative distribution function of input grayscale values of pixels in a sub-display region corresponding to the backlight partition, so as to obtain a plurality of representative backlight values;

ranking candidate ones of the plurality of backlight partitions having a representative backlight value greater than the peak stretching threshold in a descending order of the plurality of representative backlight values; and sequentially stretching the backlight signal values of the ranked candidate backlight partitions in response to a sum of power consumption increments of the backlight module due to the peak stretching processing being less than the maximum power consumption margin.

In an example, the calculating a representative backlight value of the backlight partition based on a cumulative distribution function of input grayscale values of pixels in a sub-display region corresponding to the backlight partition comprises:

performing histogram statistics on the input grayscale values of the pixels in the sub-display region to obtain a histogram reflecting a number of pixels as a function of the input grayscale values; and calculating the representative backlight value of the backlight partition using the cumulative distribution function of the input grayscale values according to the histogram.

In an example, the determining backlight signal values of the pixels in the image to be displayed comprises:

determining the backlight signal values of the pixels in the image to be displayed by processing the adjusted backlight signal values of the plurality of backlight partitions using a preset backlight diffusion function.

In an example, the method according to the embodiments of the present disclosure further comprises:

performing smoothing processing on the backlight signal values of the backlight partitions which have been subjected to the peak stretching processing, wherein the determining backlight signal values of the pixels in the image to be displayed comprises:

determining the backlight signal values of the pixels in the image to be displayed by processing the smoothed backlight signal values using a preset backlight diffusion function.

In an example, the performing smoothing processing on the backlight signal values of the backlight partitions which have been subjected to the peak stretching processing comprises:

acquiring a backlight signal value A of a backlight partition $SB_{peak}$ which has been subjected to the peak stretching processing;

acquiring a minimum value B of backlight signal values of (N×N−1) neighborhood backlight partitions of the backlight partition $SB_{peak}$, where N is an odd number greater than 1; and in response to a difference value (A-B) being greater than or equal to a smoothing threshold K, using a smoothed backlight signal value $A'=(K/(A-B))\times A+(1-K/(A-B))\times B$ as the backlight signal value of the backlight partition $SB_{peak}$.

In an example, the determining backlight signal values of a plurality of backlight partitions in the backlight module according to input grayscale values of pixels in an image to be displayed comprises:

for each of the plurality of backlight partitions, performing histogram statistics on input grayscale values of a sub-display region corresponding to the backlight partition to obtain a histogram reflecting a number of pixels as a function of the input grayscale values; and calculating a backlight signal value of the backlight partition using a cumulative distribution function of the input grayscale values according to the histogram, wherein the performing histogram statistics on input grayscale values of a sub-display region corresponding to the backlight partition comprises:

determining a percentage r of pixel area of a row or column of boundary pixels between a sub-display region $SA_i$ of a backlight partition $SB_i$ and a sub-display region $SA_j$ of a backlight partition $SB_j$ located within the sub-display region $SA_i$, where $0<r<1$, i and j are integers, $1\leq i\leq l$, $1\leq j\leq l$, l is a number of the plurality of backlight partitions in the backlight module, and the backlight partition $SB_i$ and the backlight partition $SB_j$ are adjacent ones of the plurality of backlight partitions; and performing histogram statistics on input grayscale values of pixels in the sub-display region $SA_i$ based on the percentage r of pixel area.

In an example, the power threshold of the backlight module is set to a rated power of the backlight module or a maximum power withstandable by the backlight module.

According to another aspect of the embodiments of the present disclosure, there is proposed an apparatus for driving a display device comprising a display panel and a backlight module, the apparatus comprising:

a first determination module configured to determine backlight signal values of a plurality of backlight partitions in the backlight module according to input grayscale values of pixels in an image to be displayed;

an adjustment module configured to adjust the backlight signal values of the plurality of backlight partitions by performing peak stretching processing on at least one of the plurality of backlight partitions having a backlight signal value greater than a peak stretching threshold, so that a total power consumption of the plurality of backlight partitions in the backlight module is less than a power threshold of the backlight module;

a second determination module configured to determine backlight signal values of the pixels in the image to be displayed according to the adjusted backlight signal values of the plurality of backlight partitions;

a third determination module configured to determine output grayscale values of the pixels according to the backlight signal values of the pixels and the input grayscale values of the pixels; and a driving module configured to drive the display panel using the determined output grayscale values of the pixels and drive the backlight module using the adjusted backlight signal values of the plurality of backlight partitions.

In an example, the adjustment module is further configured to:

determine a maximum power consumption margin of the backlight module according to the backlight signal values of the plurality of backlight partitions and the power threshold of the backlight module;

calculate, for each of the plurality of backlight partitions, a representative backlight value of the backlight partition based on a cumulative distribution function of input grayscale values of pixels in a sub-display region corresponding to the backlight partition, so as to obtain a plurality of representative backlight values;

rank candidate ones of the plurality of backlight partitions having a representative backlight value greater than the peak stretching threshold in a descending order of the plurality of representative backlight values; and sequentially stretch the backlight signal values of the ranked candidate backlight partitions in response to a sum of power consumption increments of the backlight module due to the peak stretching processing being less than the maximum power consumption margin.

In an example, the adjustment module is further configured to:

perform histogram statistics on the input grayscale values of the pixels in the sub-display region to obtain a histogram reflecting a number of pixels as a function of the input grayscale values; and calculate the representative backlight value of the backlight partition using the cumulative distribution function of the input grayscale values according to the histogram.

In an example, the apparatus according to the embodiments of the present disclosure further comprises:

a smoothing module configured to perform smoothing processing on the backlight signal values of the backlight partitions which have been subjected to the peak stretching processing, wherein the second determination module is further configured to:

process the smoothed backlight signal values using a preset backlight diffusion function.

In an example, the smoothing module is further configured to:

acquire a backlight signal value A of a backlight partition $SB_{peak}$ which has been subjected to the peak stretching processing;

acquire a minimum value B of backlight signal values of (N×N−1) neighborhood backlight partitions of the backlight partition $SB_{peak}$, where N is an odd number greater than 1; and in response to a difference value (A−B) between A and B being greater than or equal to a smoothing threshold K, use a smoothed backlight signal value $A'=(K/(A-B))\times A+(1-K/(A-B))\times B$ as the backlight signal value of the backlight partition $SB_{peak}$.

In an example, the first determination module is further configured to:

for each of the plurality of backlight partitions, perform histogram statistics on input grayscale values of a sub-display region corresponding to the backlight partition to obtain a histogram reflecting a number of pixels as a function of the input grayscale values; and calculate a backlight signal value of the backlight partition using a cumulative distribution function of the input grayscale values according to the histogram, wherein the first determination module is further configured to perform histogram statistics on input grayscale values of a sub-display region corresponding to the backlight partition by:

determining a percentage r of pixel area of a row or column of boundary pixels between a sub-display region $SA_i$ of a backlight partition $SB_i$ and a sub-display region $SA_j$ of a backlight partition $SB_j$ located within the sub-display region $SA_i$, where $0<r<1$, i and j are integers, $1\leq i\leq l$, $1\leq j\leq l$, l is a number of the plurality of backlight partitions in the backlight module, and the backlight partition $SB_i$ and the backlight partition $SB_j$ are adjacent ones of the plurality of backlight partitions;

performing histogram statistics on input grayscale values of pixels in the sub-display region $SA_i$ based on the percentage r of pixel area; and calculating the backlight signal value of the backlight partition $SB_i$ using the cumulative distribution function of the input grayscale values according to the histogram statistics.

According to yet another aspect of the embodiments of the present disclosure, there is proposed a driving apparatus, comprising:

a memory configured to store instructions;

at least one processor which executes instructions stored in the memory to implement the method according to the embodiments of the present disclosure.

According to a further aspect of the embodiments of the present disclosure, there is proposed a display device, comprising a display panel comprising a plurality of sub-display regions;

a backlight module comprising a plurality of backlight partitions; and the driving apparatus according to the embodiments of the present disclosure.

According to still another aspect of the embodiments of the present disclosure, there is proposed a non-transitory computer-readable storage medium having stored thereon instructions that are configured to, when executed by at least one processor, implement the method according to the embodiments of the present disclosure.

BRIEF DESCRIPTION OF THE ACCOMPANYING DRAWINGS

The above and other purposes, features, and advantages of the embodiments of the present disclosure will become more apparent through the following description of the embodiments of the present disclosure with reference to the accompanying drawings. It should be illustrated that throughout the accompanying drawings, the same elements are represented by the same or similar reference signs. In the accompanying drawings.

DETAILED DESCRIPTION

Figure 1A:
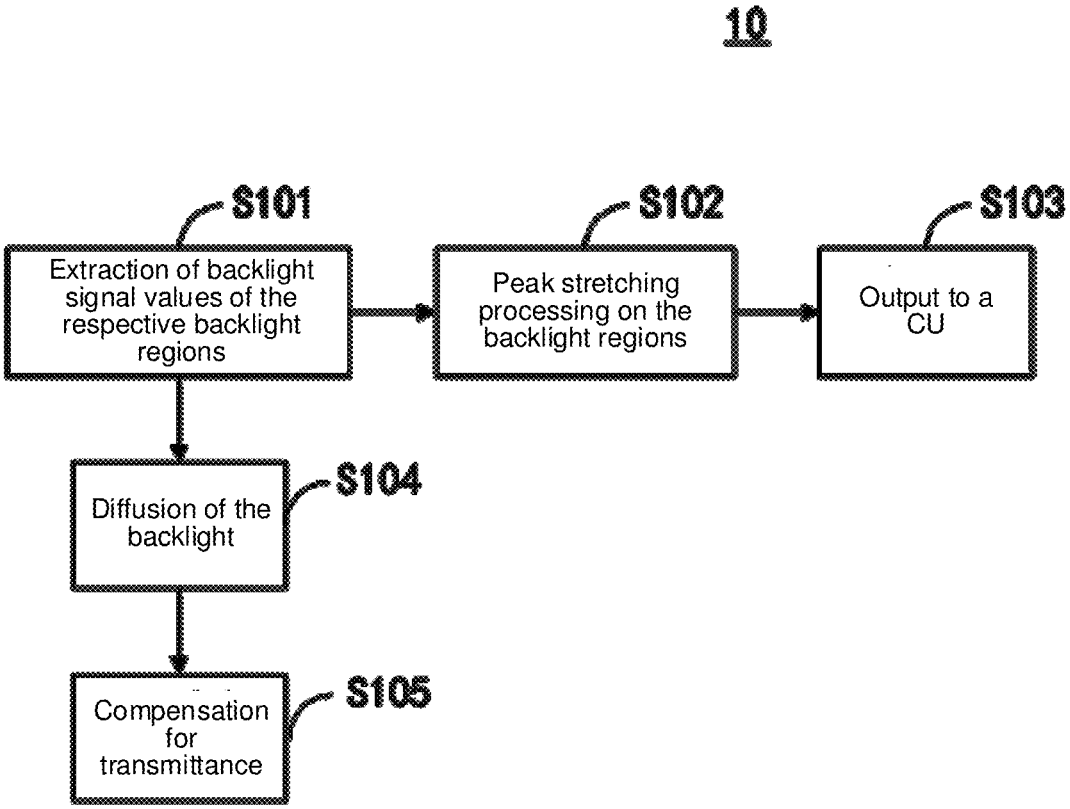
FIG. 1A illustrates a flowchart of a method for driving a display device.

In order to make the purposes, technical solutions and advantages of the embodiments of the present disclosure more clear, the technical solutions in the embodiments of the present disclosure will be clearly and completely described below in conjunction with the accompanying drawings in the embodiments of the present disclosure. Obviously, the embodiments described are a part of the embodiments of the present disclosure instead of all the embodiments. All other embodiments obtained by those of ordinary skill in the art based on the described embodiments of the present disclosure without any creative effort are within the protection scope of the present disclosure. In the following description, some specific embodiments are for illustrative purposes only and are not to be construed as limiting the present disclosure, but merely examples of the embodiments of the present disclosure. The conventional structure or construction will be omitted when it may cause confusion to the understanding of the present disclosure. It should be illustrated that shapes and dimensions of components in the figures do not reflect true sizes and proportions, but only illustrate contents of the embodiments of the present disclosure.

Furthermore, in the description of the embodiments of the present disclosure, the term "connected to" or "connected" may mean that two components are directly connected, or that two components are connected via one or more other components. In addition, the two components can be connected or coupled by wire or wirelessly.

A display device such as a liquid crystal display etc. may be controlled using a local backlight adjustment method, so as to reduce power consumption of the display device, increase a contrast of a display picture, and reduce afterimages etc. This local backlight adjustment method is substantially to divide a backlight source of the display device into a plurality of backlight partitions, and then control the respective backlight partitions independently. Peak stretching technology (i.e., peak driving technology) may also be used in combination with the method. That is, peak stretching processing is performed on backlight signal values of some of the backlight partitions, so that these backlight partitions reach possible maximum brightness, to enable details of a display picture to be clearer and further improve a contrast of the display picture. For example, light emitting devices in some backlight partitions of the display device may be provided with a maximum driving current which may be withstood by the light emitting devices. For example, if a usual current used to drive light emitting devices in a backlight module of a liquid crystal display is, for example, about 200 mA, the driving current applied to light emitting devices of a certain backlight partition may be increased to a large value, for example, 400 mA, within a range which may be withstood by the light emitting devices of the backlight module, so that a sub-display region corresponding to the backlight partition achieves greater visual brightness.

FIG. 1A illustrates a flowchart of a method for driving a display device. As shown in FIG. 1A, the method for driving a display device may comprise the following steps.

In step S101, after local backlight adjustment (i.e., local diming) is performed, a backlight signal value of each backlight partition is extracted.

In step S102, a method for performing dynamical peak stretching processing on backlight in a region is used, in which when it is determined that the backlight signal value of a backlight partition is greater than a set stretching threshold, the backlight signal value of the backlight partition is increased by L times. That is, peak stretching processing is performed on the backlight partition.

In step S103, the backlight signal value which is subjected to the peak stretching processing is directly output to a Control Unit (CU) for backlight control.

In step S104, backlight diffusion is performed on the backlight signal value output in step S101 using a backlight diffusion function to obtain a backlight signal value of each pixel as a basis for compensation for transmittance of a display panel.

In step S105, the transmittance of the display panel is compensated using an adding compensation method, i.e., adjusting display brightness of each pixel in the display panel.

Figure 1B:
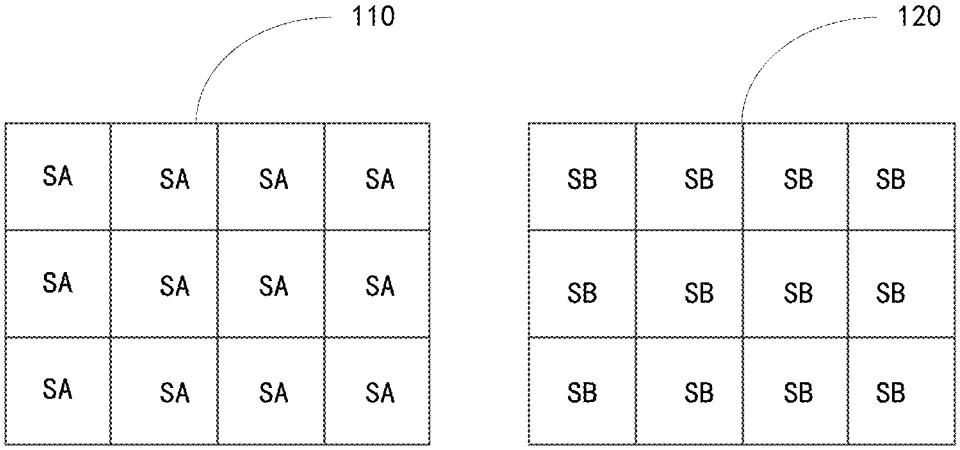
FIG. 1B illustrates a schematic diagram of a display panel and a backlight module in a display device.

It may be understood by those skilled in the art that, as shown in FIG. 1B, a display region of a display panel 110 may be divided into a plurality of sub-display regions SA. Accordingly, a backlight module 120 of a display device may also be divided into a plurality of backlight partitions SB corresponding to the plurality of sub-display regions SA. The backlight partitions SB corresponding to the respective sub-display regions SA may be driven independently, so as to achieve local backlight adjustment, i.e., local diming. The backlight partitions of the backlight module may be set in advance, and therefore the partitioning of the backlight partitions is fixed during use. However, in an actual display process, a boundary of a sub-display region corresponding to each backlight partition may not align with a boundary of a pixel, and there may be a case that a part of a certain pixel may locate in one sub-display region and another part of the pixel may locate in another adjacent sub-display region, that is, a number of pixels included in the sub-display region is not an integer. It may be considered that, in this case, the sub-display region comprises a complete pixel area corresponding to pixels completely included in the sub-display region and a non-complete pixel area corresponding to pixels partially included in the sub-display region. This case is not considered in the above step S101.

The inventors of the present application recognize that visual brightness of a certain sub-display region SA mainly depends on light transmittance of the sub-display region SA and brightness of a backlight partition SB corresponding to the sub-display region SA. At the same time, the light transmittance of the certain sub-display region SA depends on a deflection angle of a light valve such as a liquid crystal molecule, which is affected by an applied electric field, and the deflection angle is directly related to data signals provided to the sub-display region (i.e., grayscale values of pixels of a display image). Therefore, it may be considered that the visual brightness of the sub-display region is based on the data signals provided to the sub-display region and a backlight signal value of the backlight partition corresponding to the sub-display region. In the above step S102, only a backlight partition having a backlight signal value greater than a set stretching threshold is determined and a backlight signal value of the backlight partition is increased by certain times. This method does not take into account a statistical distribution of pixel values of the image displayed in the display region, may not retain image information as much as possible, and thus may not control a distortion rate of the image.

In addition, in the above step S103, the backlight signal value which is subjected to the peak stretching processing is directly output to the control unit for backlight control. This may make sub-display regions which are relatively dark originally appear too bright, which results in a large brightness difference between these sub-display regions and sub-display regions corresponding to backlight partitions which are not subjected to peak stretching processing. This may reduce uniformity of brightness of the overall display picture of the display device, which is prone to cause a bright block phenomenon and is not conducive to subsequent compensation for the transmittance of the display panel.

According to the embodiments of the present disclosure, there is proposed a method for driving a display device. It may be understood by those skilled in the art that serial numbers of various steps in the following method are only used as representations of the steps for description, and should not be regarded as indicating an execution order of the respective steps. Unless explicitly stated, the steps of the method need not to be performed exactly in the order shown, or some steps may be performed at the same time.

Figure 2:
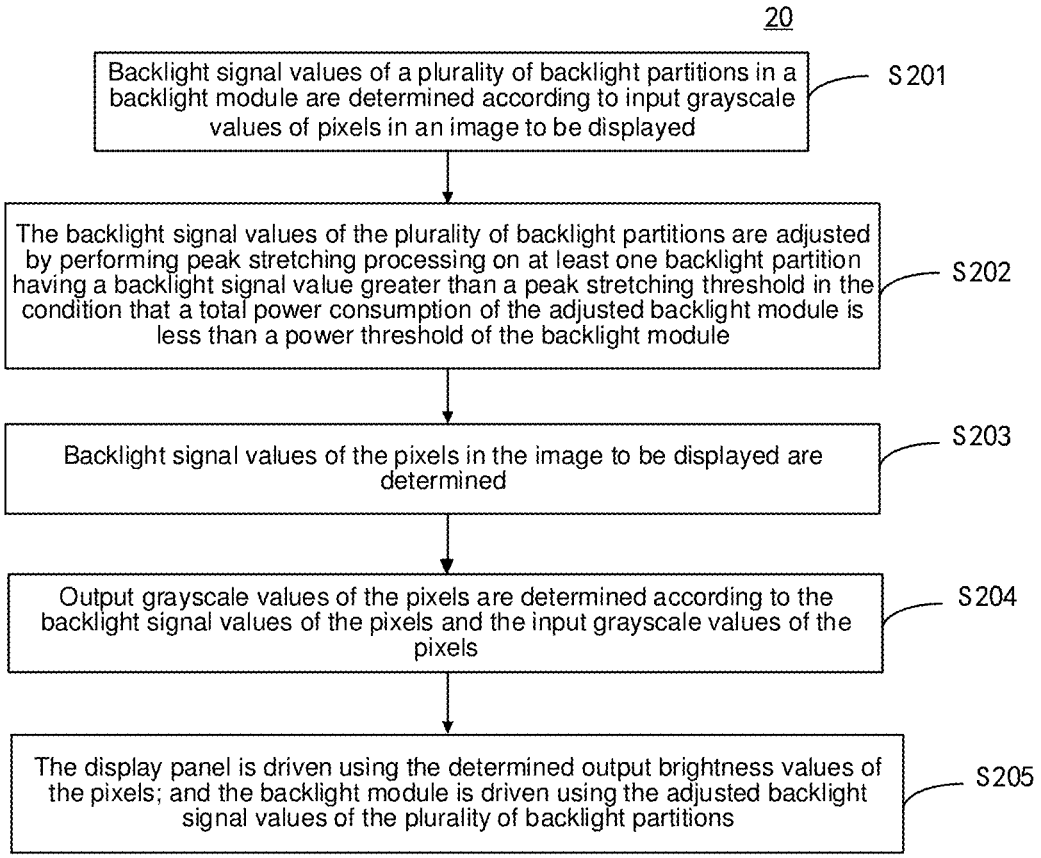
FIG. 2 illustrates a flowchart of a method for driving a display device according to an embodiment of the present disclosure.

FIG. 2 illustrates a schematic flowchart of a driving method 20 according to an embodiment of the present disclosure.

As shown in FIG. 2, in step S201, backlight signal values of a plurality of backlight partitions in a backlight module are determined according to input grayscale values of pixels in an image to be displayed.

In step S202, the backlight signal values of the plurality of backlight partitions are adjusted by performing peak stretching processing on at least one of the plurality of backlight partitions having a backlight signal value greater than a peak stretching threshold, so that a total power consumption of the plurality of backlight partitions in the backlight module is less than a power threshold of the backlight module.

In step S203, backlight signal values of the pixels in the image to be displayed are determined according to the adjusted backlight signal values of the plurality of backlight partitions.

In step S204, output grayscale values of the pixels are determined according to the backlight signal values of the pixels and the input grayscale values of the pixels.

In step S205, the display panel is driven using the determined output grayscale values of the pixels; and the backlight module is driven using the adjusted backlight signal values of the plurality of backlight partitions.

Next, the driving method 20 according to the embodiment of the present disclosure will be described in detail with reference to the accompanying drawings.

According to the embodiment of the present disclosure, in step S201, a spatial domain conversion may further be performed on the input image to be displayed. For example, an original input image in a RGB format may be converted to a Hue, Saturation, brightness Value (HSV) color space format, to separate hue, saturation, and brightness components of the original image, and use the brightness value components (denoted as components V) as input grayscale values of pixels in subsequent processing, so as to retain brightness of the original image as much as possible. It may be understood by those skilled in the art that the RGB-HSV color space conversion may be performed using various methods, so that the components V which are obtained by the HSV conversion may be grayscale values from 0 to 255, which will not be described in detail for brevity. In addition, when the display panel is driven according to the determined output grayscale values of the respective pixels in step S205, it is necessary to convert the output grayscale values of the respective pixels in the HSV color space into RGB data signals to drive the display panel for display.

According to the embodiment of the present disclosure, in step S201, a percentage r of pixel area of a row or column of boundary pixels between a sub-display region $SA_i$ of a backlight partition $SB_i$ and a sub-display region $SA_j$ of a backlight partition $SB_j$ located within the sub-display region $SA_i$ may further be determined, wherein $0<r<1$, i is an integer, $1\leq i\leq l$, $1\leq j\leq l$, and l is a number of the plurality of backlight partitions in the backlight module. The backlight partition $SB_i$ and the backlight partition $SB_j$ are adjacent ones of the plurality of backlight partitions. It may be understood by those skilled in the art that there may be more than one backlight partition $SB_j$. In step S201, a histogram statistics of input grayscale values of pixels in the sub-display region $SA_i$ may be calculated based on the percentage r of pixel area. Then, a backlight signal value of the backlight partition $SB_i$ is calculated using a cumulative distribution function of the input grayscale values according to the histogram statistics.

Figure 3:
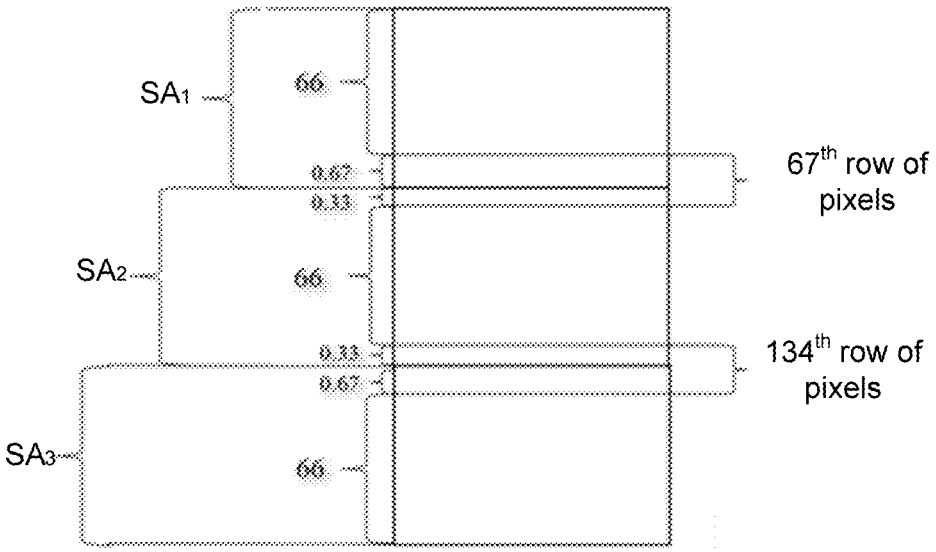
FIG. 3 illustrates an exemplary schematic diagram of performing processing on a non-complete pixel area in a sub-display region according to an embodiment of the present disclosure.

FIG. 3 illustrates an exemplary schematic diagram of performing processing on a non-complete pixel area in a sub-display region according to an embodiment of the present disclosure. FIG. 3 illustrates three sub-display regions $SA_1$, $SA_2$ and $SA_3$, which correspond to preset backlight partitions $SB_1$, $SB_2$ and $SB_3$ respectively.

As shown in FIG. 3, when processing is performed on a non-complete pixel area in the sub-display region $SA_1$, a percentage r of pixel area of a row (for example, a $67^{th}$ row) of boundary pixels between the sub-display region $SA_1$ and the adjacent sub-display region $SA_2$ located within the sub-display region $SA_1$ is 0.67, that is, 67% of the pixel area of the $67^{th}$ row of pixels is located within the sub-display region $SA_1$. Since 67% of the pixel area of the $67^{th}$ row is located within the sub-display region $SA_1$, when histogram statistics is subsequently performed on the sub-display region $SA_1$, for the $67^{th}$ row of pixels, a number of pixels having a corresponding grayscale value is multiplied by a coefficient of 67%=0.67. When processing is performed on a non-complete pixel area in the sub-display region $SA_2$, a percentage r of pixel area of the row (for example, the $67^{th}$ row) of boundary pixels between the sub-display region $SA_2$ and the adjacent sub-display region $SA_1$ located within the sub-display region $SA_2$ is 0.33, that is, 33% of the pixel area of the $67^{th}$ row of pixels is located within the sub-display region $SA_2$. Since 33% of the pixel area of the $67^{th}$ row is located within the sub-display region $SA_2$, when histogram statistics is subsequently performed on the sub-display region $SA_2$, for the $67^{th}$ row of pixels, a number of pixels having a corresponding grayscale value is multiplied by a coefficient of 33%=0.33. In addition, a percentage r of pixel area of a row (for example, a $134^{th}$ row) of boundary pixels between the sub-display region $SA_2$ and the adjacent sub-display region $SA_3$ located within the sub-display region $SA_2$ is 0.33. When histogram statistics is subsequently performed on the sub-display region $SA_2$, for the $134^{th}$ row of pixels, a number of pixels having a corresponding grayscale value is multiplied by a coefficient of 33%=0.33. When processing is performed on the sub-display region $SA_3$, a percentage r of pixel area of the row (for example, the $134^{th}$ row) of boundary pixels between the sub-display region $SA_3$ and the adjacent sub-display region $SA_2$ located within the sub-display region $SA_3$ is 0.67, that is, for the $134^{th}$ row of pixels, 67% of the pixel area is located within the sub-display region $SA_3$. Since 67% of the pixel area of the $134^{th}$ row is located within the sub-display region $SA_3$, when histogram statistics is subsequently performed on the sub-display region $SA_3$, for the $134^{th}$ row of pixels, a number of pixels having a corresponding grayscale value is multiplied by a coefficient of 67%=0.67.

Next, an exemplary process of performing histogram statistics on input grayscale values of pixels in each sub-display region in the above step S201 will be described in detail. When histogram statistics is performed, for each sub-display region, a cumulative sum of a number of pixels having one of the input grayscale values from 0 to 255 is calculated. For example, for the sub-display region $SA_1$, when statistics is performed on a cumulative sum of a number of pixels having one of the input grayscale values from 0 to 255 for the $67^{th}$ row of pixels, since 67% of the pixel area of the $67^{th}$ row is considered to be in the sub-display region $SA_1$, a number of pixels having a corresponding grayscale value is multiplied by a coefficient of 67%=0.67. For example, in an example in which the sub-display region $SA_1$ comprises a first row of pixels to the $67^{th}$ row of pixels, it is assumed that 124 pixels in total from the first row of pixels to the $66^{th}$ row of pixels have an input grayscale value of 155, and 24 pixels in the $67^{th}$ row have the grayscale value of 155. When statistics is performed on a number of pixels having the input grayscale value of 155 for the sub-display region $SA_1$, a number of pixels having the input grayscale value of 155 in the $67^{th}$ row is considered to be $24\times0.67=16$, and therefore a number of pixels having the pixel grayscale value of 155 in the sub-display region $SA_1$ is (124+16)=140. Similarly, for the sub-display region $SA_2$, when statistics is performed on a cumulative sum of a number of pixels having one of the input grayscale values from 0 to 255 for the $67^{th}$ row of pixels, since 33% of each pixel in the $67^{th}$ row is considered to be in the sub-display region $SA_2$, a number of pixels having a corresponding grayscale value is multiplied by a coefficient of 33%=0.33; and when statistics is performed on a cumulative sum of a number of pixels having one of the input grayscale values from 0 to 255 for the $134^{th}$ row of pixels, since 33% of each pixel in the $134^{th}$ row is considered to be in the sub-display region $SA_2$, a number of pixels having a corresponding grayscale value is multiplied by a coefficient of 33%=0.33. For the sub-display region $SA_3$, when statistics is performed on a cumulative sum of a number of pixels having one of the input grayscale values from 0 to 255 for the $134^{th}$ row of pixels, since 67% of each pixel in the $134^{th}$ row is considered to be in the sub-display region $SA_3$, a number of pixels having a corresponding grayscale value is multiplied by a coefficient of 67%=0.67. Since a number of pixels having a certain grayscale that is obtained in this way may not be an integer, the number of pixels may be rounded.

It may be understood by those skilled in the art that although the above examples are described by using rows of boundary pixels as an example, the method according to the embodiment of the present disclosure may of course be applied to a case of columns of boundary pixels, which will not be repeated here for brevity.

After histogram statistics is performed, a pixel number distribution of the respective input grayscale values in each sub-display region may be obtained. Then, a Probability Density Function (PDF) and a Cumulative Distribution Function (CDF) of the input grayscale values in each sub-display region are calculated according to the histogram statistics.

Figure 4:
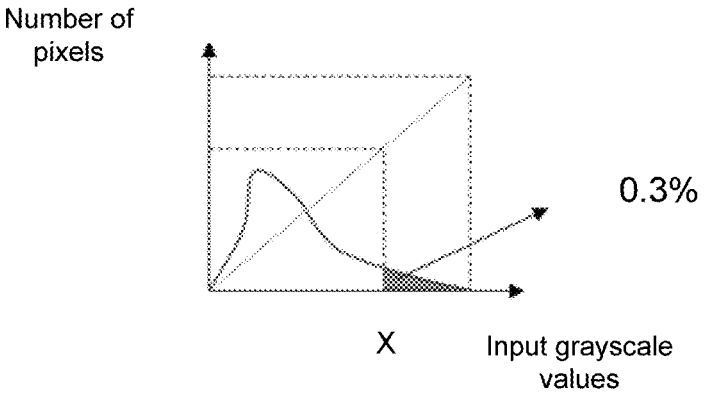
FIG. 4 illustrates an exemplary schematic diagram of determining a backlight signal value.

FIG. 4 illustrates an exemplary schematic diagram of determining a backlight signal value of each backlight partition $SB_i$. As shown in FIG. 4, for the sub-display region $SA_i$, for example, an input grayscale value when a CDF is 0.003 may be used as the backlight signal value of the backlight partition $SB_i$. When the CDF is 0.003, it is equivalent to use, as the backlight signal value of the backlight partition $SB_i$, an input grayscale value X when a cumulative result of a number of pixels is 0.3% of a total number of pixels in the sub-display region $SA_i$ in a histogram statistical result in a descending order of input grayscale values. This method is used to determine the backlight signal value of each backlight partition $SB_i$ by primarily performing statistics on the input grayscale values of all pixels in the sub-display region and acquiring the backlight signal value of the backlight partition $SB_i$ using a statistics method. In this way, the backlight signal value may be obtained by taking a pixel value distribution of the image to be displayed into account, so that details of the image to be displayed are better retained without distorting the final display image.

It may be understood by those skilled in the art that, in step S201, a value of the CDF to be used may be set to be slightly larger, for example, 0.003. Thereby, for each sub-display region $SA_i$, the backlight signal value of the backlight partition $SB_i$ may be acquired by taking an input grayscale value of fewer pixels into account, which may reduce the influence of noise points that may exist in the sub-display region $SA_i$ on the backlight signal value. In addition, it may be understood by those skilled in the art that other values of the CDF may of course be used in S201.

According to the embodiment of the present disclosure, a number of pixels having a respective input grayscale value included in each sub-display region is calculated more accurately by taking the case that a number of pixels included in the sub-display region for the backlight partition is not an integer into account, which further improves the accuracy of statistics on the histogram, thereby improving the accuracy of subsequent processing. In addition, in the above step S201, the backlight signal values of the plurality of backlight partitions in the backlight module which are determined according to the input grayscale values of the respective pixels in the input image to be displayed may also be specifically implemented in other manners. For example, an average value of the input grayscale values of all pixels in the sub-display region is used as the backlight signal value corresponding to the backlight partition, which is not limited herein.

Figure 5:
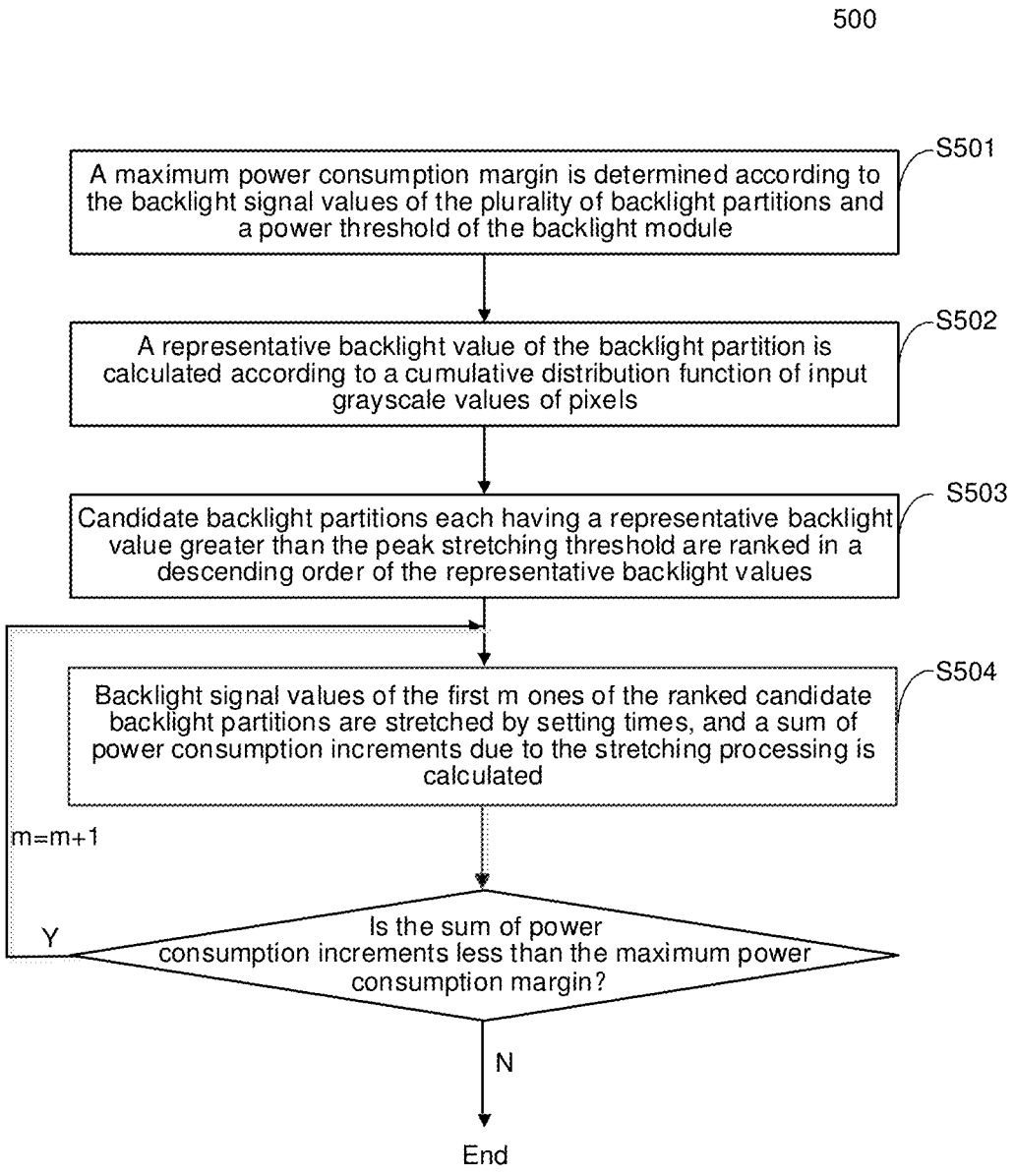
FIG. 5 illustrates a flowchart of an exemplary method for performing peak stretching processing according to an embodiment of the present disclosure.

According to the embodiment of the present disclosure, in step S202, the backlight signal values of the plurality of backlight partitions are adjusted by performing peak stretching processing on at least one of the plurality of backlight partitions having a backlight signal value greater than a peak stretching threshold. FIG. 5 illustrates a flowchart of an exemplary method for performing peak stretching processing according to an embodiment of the present disclosure. As shown in FIG. 5, the method 500 for performing peak stretching processing according to the embodiment of the present disclosure may comprise the following steps.

In step S501, a maximum power consumption margin of the backlight module is determined according to the backlight signal values of the plurality of backlight partitions and a power threshold of the backlight module.

In step S502, a representative backlight value of the backlight partition is calculated for each of the plurality of backlight partitions based on a cumulative distribution function of input grayscale values of pixels in a sub-display region corresponding to the backlight partition, so as to obtain a plurality of representative backlight values. According to the description below, it may be learned that the representative backlight value is a backlight value which is determined according to a specific value of the CDF for comparison with the peak stretching threshold. Here, "representative" is only used for naming the value, and does not provide additional restrictions.

In step S503, candidate ones of the plurality of backlight partitions having a representative backlight value greater than the peak stretching threshold are ranked in a descending order of the plurality of representative backlight values.

In step S504, the backlight signal values of the ranked candidate backlight partitions are sequentially stretched by setting times in response to a sum of power consumption increments of the backlight module due to the peak stretching processing being less than the maximum power consumption margin.

Next, the exemplary method for performing peak stretching processing according to the embodiment of the present disclosure shown in FIG. 5 will be described in detail.

In step S501, a maximum power consumption margin $\Delta P$ of the backlight module is determined according to the power threshold of the backlight module and the backlight signal values of the plurality of backlight partitions obtained in step S201. For example, the power threshold of the backlight module may be a rated power of the backlight module or a maximum power which may be withstood by the backlight module.

For example, a first power consumption value P1 of the backlight module may be calculated according to the backlight signal values of the respective backlight partitions in the plurality of backlight partitions obtained in step 201. Specifically, a power consumption of each backlight partition may be calculated according to a backlight signal value of the backlight partition, and the first power consumption value P1 of the backlight module may be obtained by adding the power consumptions of the respective backlight partitions. Then, the power threshold of the backlight module is used as a second power consumption value P2. A maximum power consumption margin may be obtained by subtracting the first power consumption value P1 from the second power consumption value P2, $\Delta P = P2 - P1$.

In step S502, a representative backlight value of each backlight partition $SB_i$ is calculated based on a cumulative distribution function of input grayscale values of pixels in each sub-display region $SA_i$. For example, histogram statistics may be performed on the input grayscale values of the pixels in each sub-display region $SA_i$, and a cumulative distribution function CDF of the input grayscale values of the sub-display region $SA_i$ may be obtained based on the histogram statistics. For example, a grayscale value when the CDF is 0.05 may be used as a representative backlight value of the corresponding backlight partition $SB_i$. When the CDF is 0.05, it is equivalent to use, as the representative backlight value of the backlight partition $SB_i$, an input grayscale value Y when a cumulative result of a corresponding number of pixels is 5% of a total number of pixels in the sub-display region $SA_i$ in a histogram statistical result in a descending order of input grayscale values. This method is used to determine the representative backlight value Y of each backlight partition $SB_i$.

As shown in FIG. 4, a continuous curve in FIG. 4 may be considered as a plurality of vertical bars (for example, 256 vertical bars corresponding to grayscales) which are closely arranged, i.e., a histogram, and each vertical bar corresponds to one input grayscale value, and has a height corresponding to a number of pixels having this grayscale value. Then, each vertical bar is a value of a PDF at a grayscale value where the vertical bar is located. A sum of areas of all vertical bars from the highest grayscale value to a grayscale value where a vertical bar is located is a value of the CDF at the grayscale value.

It may be understood by those skilled in the art that in step S502, the value of the CDF to be used may be set to be slightly larger, for example, 0.05. Thereby, for each sub-display region $SA_i$, a representative backlight value of the backlight partition $SB_i$ may be acquired by taking an input grayscale value of more pixels into account. This is completely different from the above step S201 in which the value of the CDF may be set to be slightly smaller (for example, 0.003). Thereby, the backlight signal value X and the representative backlight value Y obtained for the same backlight partition $SB_i$ may be the same or different. In addition, it may be understood by those skilled in the art that other values of the CDF may of course be used in S502.

It may be understood by those skilled in the art that the representative backlight value may also be calculated using an average value method. For example, an average value of pixel grayscale values of all pixels in the sub-display region $SA_i$ is taken as the representative backlight value of the backlight partition $SB_i$. However, since the average value method does not take into account distribution characteristics of the grayscale values of the pixels in the sub-display region $SA_i$, the representative backlight values of the backlight partitions which are acquired using the average value method may not well retain effective information of the image to be displayed. In addition, when backlight partitions which are to be subjected to peak stretching processing are selected using the representative backlight values of the backlight partitions which are acquired using the average value method, a range of the backlight partitions which are to be subjected to peak stretching processing may not be adjusted according to actual needs. Compared with the average value method, the cumulative distribution function CDF takes into account not only the grayscale values of the pixels, but also the distribution of the grayscale values of the pixels, and therefore the effective information of the image to be displayed may be retained as much as possible. In addition, the range of the backlight partitions which are to be subjected to peak stretching processing may be flexibly adjusted using different values of the CDF, by simply adjusting the value of the CDF. For example, in a case where a peak stretching threshold T is given, the value of the CDF is increased, for example, the value of the CDF, which is equal to 0.05, may be changed to 0.1, which means that the representative backlight value which is acquired in this way may decrease, and therefore the range of the backlight partitions which are to be subjected to peak stretching processing may be reduced. Similarly, in a case where the peak stretching threshold T is given, the value of the CDF is decreased, for example, the value of the CDF, which is equal to 0.05, may be changed to 0.01, which means that the representative backlight value which is acquired in this way may increase, and therefore the range of the backlight partitions which are to be subjected to peak stretching processing may be increased. Therefore, according to the embodiment of the present disclosure, there is provided a more flexible method to determine the backlight partitions which are to be subjected to peak stretching processing.

According to the embodiment of the present disclosure, compared with a case where the average value of the input grayscale values (i.e., the grayscale values of the pixels) of the sub-display region $SA_i$ is used as the representative backlight value of the backlight partition $SB_i$, when the cumulative distribution function CDF of the input grayscale values is used, most of image information may be effectively retained while reducing a number of backlight partitions which are to be subjected to peak stretching processing, thereby ensuring that the peak stretching processing is performed only on a backlight partition having a large backlight signal value. In addition, according to the embodiment of the present disclosure, the range of the backlight partitions which are subjected to the peak stretching processing may be adjusted by only adjusting the value of the CDF, thereby achieving a more flexible control method.

Then, in step S503, the candidate backlight partitions $SB_c$ having a representative backlight value greater than the peak stretching threshold T are ranked in a descending order of the representative backlight values. For example, the respective candidate backlight partitions $SB_c$ are ranked according to a descending order of the representative backlight values, and then respective backlight partitions having a representative backlight value greater than the peak stretching threshold T are selected as candidate backlight partitions $SB_c$. Alternatively, respective backlight partitions having a representative backlight value greater than the peak stretching threshold T may also be firstly selected as candidate backlight partitions $SB_c$, and then the candidate backlight partitions $SB_c$ are ranked in a descending order of the representative backlight values. It may be understood by those skilled in the art that the peak stretching threshold T may be flexibly set according to practical applications, so that the peak stretching processing is performed only on a backlight partition having a representative backlight value greater than the peak stretching threshold T, to avoid over-bright display.

Next, in step S504, the backlight signal values of the ranked candidate backlight partitions are sequentially stretched by setting times until a sum of power consumption increments due to the peak stretching processing is greater than or equal to the maximum power consumption margin ΔP which is acquired in step S501.

For example, firstly, m=1, and after peak stretching processing is performed on a backlight signal value of a candidate backlight partition which is ranked in the first place (that is, a candidate backlight partition having the largest representative backlight value), a power increment Δp1 caused by the peak stretching processing (i.e., an amount of power change before performing peak stretching processing and after performing peak stretching processing) is determined, and it is determined whether a sum of the power increments (Δp1+0)=Δp1 is less than the maximum power consumption margin ΔP. If Δp1<ΔP, peak stretching processing is performed on a backlight signal value of a candidate backlight partition which is ranked in the second place, a power increment Δp2 caused by the peak stretching processing is determined, m=2, and it is determined whether a sum of the power increment Δp2 and the power increment Δp1, i.e., (Δp1+Δp2), is less than or equal to the maximum power consumption margin ΔP. If so, peak stretching processing is performed a backlight signal value of a candidate backlight partition which is ranked in the third place, and so on. For example, if a sum of the power increments (Δp1+Δp2+Δp3+Δp4+Δp5) obtained after peak stretching processing is performed on a backlight signal value of a candidate backlight partition which is ranked in the fifth place is no less than the maximum power consumption margin ΔP, the peak stretching processing on the backlight signal value of the candidate backlight partition which is ranked in the fifth place is canceled, that is, a final result is that the peak stretching processing is performed on the backlight signal values of the candidate backlight partitions which are ranked in the first place to the fourth place. It may be understood by those skilled in the art that various methods may be used to perform the peak stretching processing, which will not be repeated here for brevity.

Figure 6A:
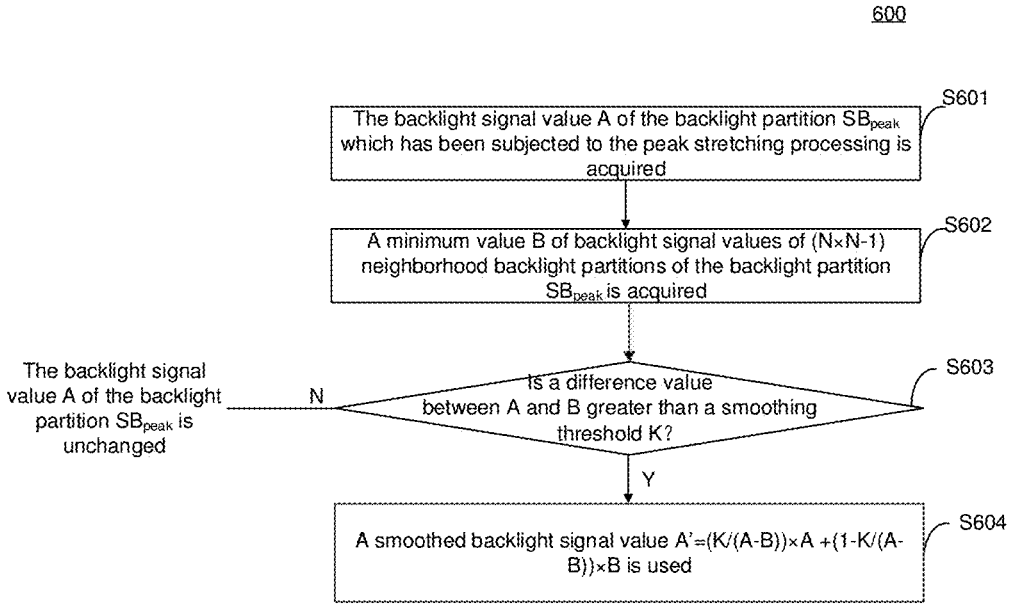
FIG. 6A illustrates an exemplary flowchart of performing smoothing processing according to an embodiment of the present disclosure.

According to the embodiment of the present disclosure, since there may be a large difference between backlight signal values of a backlight partition $SB_{peak}$ which has been subjected to the peak stretching processing and a neighborhood backlight partition, it is prone to cause occurrence of bright blocks. Therefore, according to the embodiment of the present disclosure, smoothing processing may further be performed on the backlight signal value of the backlight partition which has been subjected to the peak stretching processing. FIG. 6A illustrates an exemplary flowchart of performing smoothing processing according to an embodiment of the present disclosure. As shown in FIG. 6A, a method 600 for performing smoothing processing on a backlight signal value of a backlight partition which has been subjected to peak stretching processing according to an embodiment of the present disclosure may comprise the following steps.

In step S601, the backlight signal value A of the backlight partition $SB_{peak}$ which has been subjected to the peak stretching processing is acquired.

In step S602, a minimum value B of backlight signal values of (N×N−1) neighborhood backlight partitions of the backlight partition $SB_{peak}$ is acquired, where N is an odd number greater than 1.

In step S603, it is determined whether a difference value (A−B) between A and B is greater than a smoothing threshold K.

In step S604, if the difference value (A−B) is greater than the smoothing threshold K, a smoothed backlight signal value A'=(K/(A−B)) xA+(1−K/(A-B))×B is used as the backlight signal value of the backlight partition $SB_{peak}$.

In step S605, if the difference value (A−B) is less than or equal to the smoothing threshold K, the backlight signal value A of the backlight partition $SB_{peak}$ does not change.

According to the embodiment of the present disclosure, the smoothing method shown in FIG. 6A may be sequentially performed on all backlight partitions which have been subjected to the peak stretching processing. The difference value between the backlight signal values of the backlight partition $SB_{peak}$ which has been subjected to the peak stretching processing and each of the neighborhood backlight partitions thereof is controlled within a range K, so that a transition from the backlight partition $SB_{peak}$ which has been subjected to the peak stretching processing to a backlight partition which has not been subjected to the peak stretching processing is smoother.

Figure 6B:
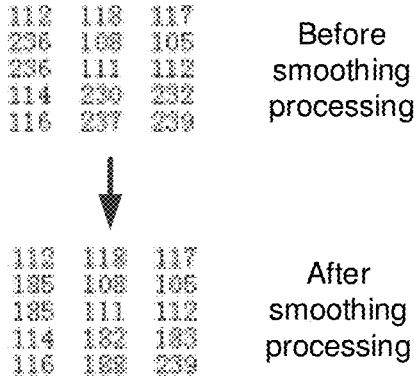
FIG. 6B illustrates an exemplary diagram of comparison before performing smoothing processing and after performing smoothing processing according to an embodiment of the present disclosure.

According to the embodiment of the present disclosure, the difference value between the backlight signal values of the backlight partitions may be adjusted by only adjusting the smoothing threshold K. The smoothing threshold K may be selected based on a linear relationship between brightness of the backlight module and backlight signal values, that is, as the backlight signal value increases, the brightness of the backlight module increases linearly. For example, by taking a 4-bit backlight screen as an example and taking an intermediate backlight signal value of 127 relative to a maximum backlight signal value of 255 as a reference value, it may be considered that a brightness difference between brightness when the backlight signal value is less than or equal to 210 and brightness when the backlight signal value is equal to 127 is acceptable to human eyes. Therefore, the purpose of the smoothing is to smooth the backlight signal value which has been subjected to the peak stretching processing to 210. At this time, the smoothing threshold K may be set to 210−127=83, so that a difference between backlight signal values of neighborhood backlight partitions may be maintained in a range of less than or equal to 83. FIG. 6B illustrates an exemplary diagram of comparison before performing smoothing processing and after performing smoothing processing according to an embodiment of the present disclosure. As shown in FIG. 6B, by taking K being equal to 83 as an example, FIG. 6B illustrates a comparison of backlight signal values before performing smoothing processing and after performing smoothing processing. It may be seen that before a smoothing operation is performed, backlight signal values of backlight partitions which have a difference value greater than 83 from a backlight signal value of a neighborhood backlight partition are 236, 230, 237 and 232. After the smoothing operation is performed, the backlight signal values of 236, 230, 237 and 232 are adjusted to 185, 182, 188 and 183 respectively, which makes the transition between the backlight partitions smoother and avoids occurrence of bright blocks.

According to the embodiment of the present disclosure, in step S203, the adjusted backlight signal values of the plurality of backlight partitions may be processed using a preset backlight diffusion function to determine backlight signal values of the respective pixels in the image to be displayed. For example, the adjusted backlight signal values of the plurality of backlight partitions may be diffused to pixels in the respective sub-display regions using a Point Spread Function (PSF) to obtain backlight signal values of the respective pixels. According to the embodiment of the present disclosure, in order to improve the accuracy of the PSF processing, for example, the backlight signal values of the respective pixels which are acquired by the PSF processing may be subjected to normalization processing and data interpolation row by row, and are fitted to a curve, and the backlight signal values of the respective pixels may be obtained from the fitted curve. It may be understood by those skilled in the art that backlight diffusion may be performed using various methods to obtain the backlight signal values of the respective pixels, and the embodiments of the present disclosure are not limited to the above examples.

According to the embodiment of the present disclosure, the "backlight signal values of the pixels" may be understood as compensation for visual brightness of each pixel in the image to be displayed by brightness of backlight partitions. In addition, it may be understood by those skilled in the art that the "the adjusted backlight signal values of the plurality of backlight partitions" may be smoothed backlight signal values, or may also be backlight signal values without performing smoothing.

According to the embodiment of the present disclosure, in order to achieve a better compensation effect, in step S204, an output grayscale value of a pixel is determined according to a backlight signal value and an input grayscale value of the pixel.

Figure 7A:
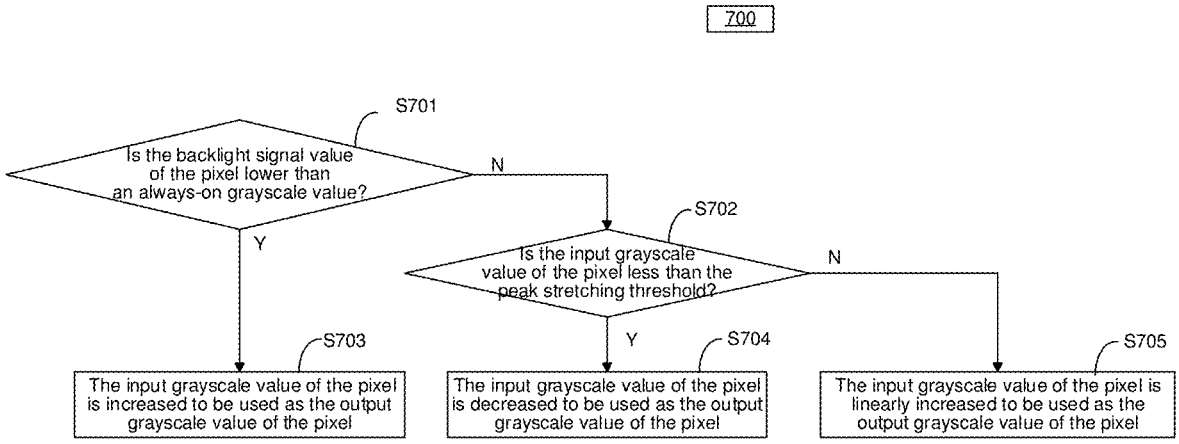
FIG. 7A illustrates an exemplary flowchart of determining an output grayscale value of each pixel according to an embodiment of the present disclosure.

FIG. 7A illustrates an exemplary flowchart of determining an output grayscale value of each pixel according to an embodiment of the present disclosure. As shown in FIG. 7A, a method 700 for determining an output grayscale value of each pixel according to an embodiment of the present disclosure may comprise the following steps.

In step S701, it is determined whether the backlight signal value of the pixel is lower than an always-on grayscale value; if so, step S703 is performed; and if not, step S702 is performed.

In step S702, it is determined whether the input grayscale value of the pixel is less than the peak stretching threshold T; if so, step S704 is performed; and if not, step S705 is performed.

In step S703, the input grayscale value of the pixel is increased to obtain the output grayscale value of the pixel.

In step S704, the input grayscale value of the pixel is decreased to obtain the output grayscale value of the pixel.

In step S705, the input grayscale value of the pixel is linearly stretched to obtain the output grayscale value.

It may be understood by those skilled in the art that the output grayscale value of each pixel obtained above is substantially a component V in an HSV space. When it is to drive the display panel, the output grayscale value of each pixel needs to be converted from the HSV color space into an RGB data signal for display. The conversion from the HSV color space into the RGB data signal may be achieved using an inverse conversion of the RGB-HSV conversion used in step 201.

Figure 7B:
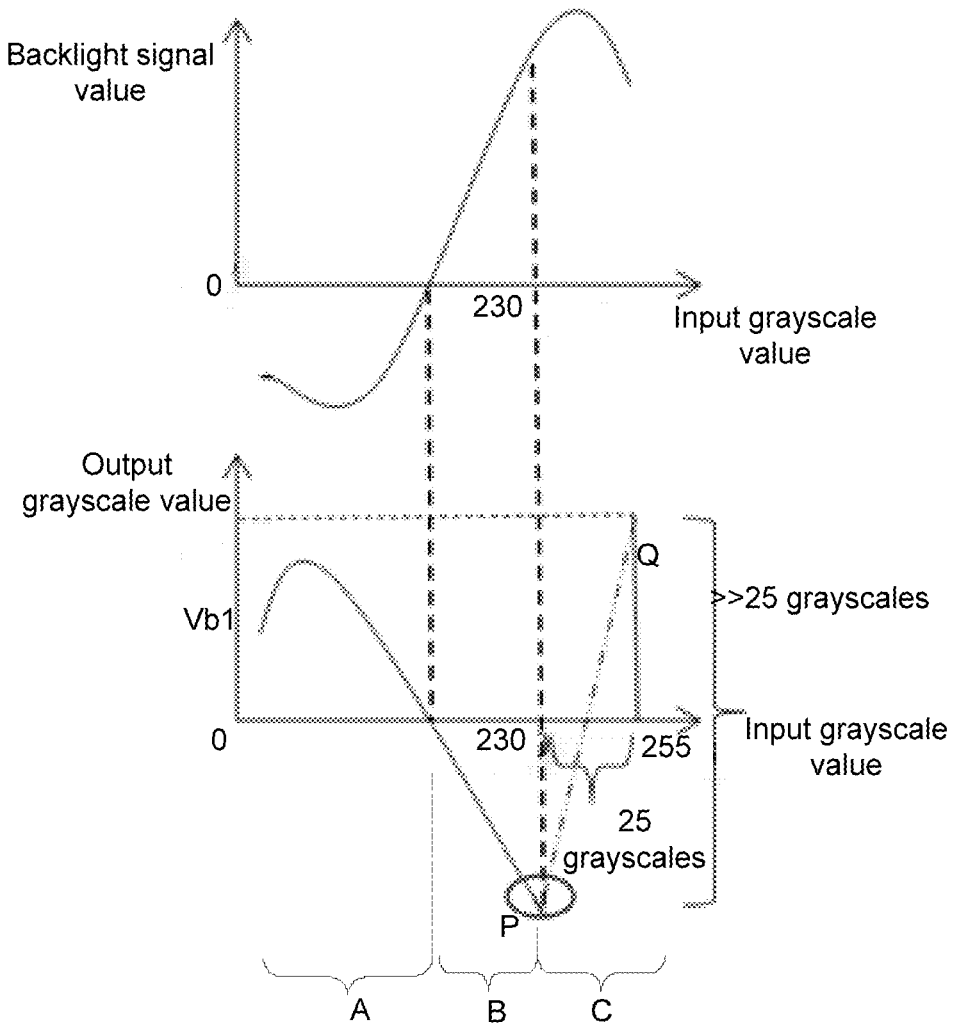
FIG. 7B illustrates a schematic diagram of determining an output grayscale value of each pixel according to an embodiment of the present disclosure.

According to the embodiment of the present disclosure, the term "always-on grayscale value" may refer to a grayscale value corresponding to the pixel when the backlight partition emits light at the maximum brightness, for example, 255, and of course, the grayscale value may also be set to other values. According to the embodiment of the present disclosure, in a case where a backlight module is given, the "always-on grayscale value" may be a constant. FIG. 7B illustrates a schematic diagram of determining an output grayscale value of each pixel according to an embodiment of the present disclosure. As shown in FIG. 7B, for example, the always-on grayscale value may be 255, and the output grayscale value is $V_{bl}$ at this time. In the above step S703, the backlight signal value of the pixel is less than 255, and according to a criterion that display brightness observed by human eyes before and after the change is constant, the output grayscale value of the pixel needs to be increased accordingly, that is, increased to be greater than $V_{bl}$. Therefore, as shown in section A of the figure, when the output grayscale value is adjusted according to the input grayscale value, the output grayscale value needs to be increased to be greater than $V_{bl}$. When the output grayscale value of the pixel is adjusted in the above step S704, the backlight signal value of the pixel is greater than or equal to 255 due to the peak stretching processing. At this time, when the output grayscale value is adjusted according to the input grayscale value, the output grayscale value needs to be decreased to be less than $V_{bl}$, as shown in section B in the figure. In the above step S705, in order to ensure the continuity of transmittance, it is necessary to maintain the continuity of the transmittance between point P and point Q in the figure, wherein point P indicates the peak stretching threshold, which is 230 in the figure as an example, and point Q indicates that when the input grayscale value is a maximum value, the corresponding output grayscale value is also a maximum value, for example, the input grayscale value and the output grayscale value are both 255.

In one example, when it is determined that the backlight signal value of the pixel is lower than the always-on grayscale value, the output grayscale value of the pixel may be determined according to the following formula (1):

$$V_{output}=V_0+(bl_{max}-bl_{psf})\times V_0/M \quad (1);$$

wherein $V_{output}$ represents the output grayscale value of the pixel, $V_0$ represents the input grayscale value of the pixel, $bl_{psf}$ represents the backlight signal value of the pixel, $bl_{max}$ represents the maximum value of the backlight signal value of each pixel, and M represents the always-on grayscale value, which is generally 255.

When it is determined that the backlight signal value of the pixel is higher than or equal to the threshold grayscale value and the input grayscale value of the pixel is less than the peak stretching threshold T, the output grayscale value of the pixel may be determined according to the following formula 2a:

$$V_{output}=V_0\times(M/bl_{psf}) \quad (2a);$$

wherein $V_{output}$ represents the output grayscale value of the pixel, $V_0$ represents the input grayscale value of the pixel, $bl_{psf}$ represents the backlight signal value of the pixel, and M represents the always-on grayscale value, which is generally 255.

When it is determined that the backlight signal value of the pixel is higher than or equal to the threshold grayscale value, and the input grayscale value of the pixel is greater than or equal to the peak stretching threshold T, the output grayscale value of the pixel may be determined according to the following formula 3a:

$$V_{output}=((M-T\times(M/bl_{psf}))/(M-T))\times(V_0-M)+M \quad (3a);$$

wherein $V_{output}$ represents the output grayscale value of the pixel, $V_0$ represents the input grayscale value of the pixel, $bl_{psf}$ represents the backlight signal value of the pixel, T represents the peak stretching threshold, and M represents the always-on grayscale value, which is generally 255.

When the above formulas 2a and 3a are used, although the bright block problem is effectively solved, the obtained display image is prone to have a black spot problem, which may affect the display effect. This is because, for example, a difference between original brightness values of two adjacent pixels is only 2, but after adjustment is performed using the above formulas 2a and 3a, the difference between the brightness values reaches 10. It may be seen from FIG. 7B that pixels in a stretching region C are represented by 25 input grayscale values in an original image. After adjustment is performed using the above formulas 2a and 3a, the pixels need to be represented by >>25 (more than 100) output grayscale values, which is primarily to achieve the continuous change of the output grayscale values, and the 25 input grayscale values in the original image need to be allocated using much more than 25 output grayscale values in the display image, and therefore a difference between output grayscale values of adjacent pixels in the display image is enlarged, which thus causes the black spot problem.

To this end, the peak stretching threshold T may be decreased (represented as movement of the point P to the left in FIG. 7B), and a number of the output grayscale values of the stretching region section C may be reduced (represented as movement of the point P in an upward direction in FIG. 7B). Further, in consideration that the influence of the peak stretching threshold T on the actual image may not be too small, the formulas 2a and 3a are improved from the perspective of the movement of the point P in the upward direction.

Based thereon, the output grayscale value of the pixel may be determined according to the following formula 2b:

$$V_{output}=V_0\times((M+(bl_{psf}-M)/a)/bl_{psf})^{(1/\gamma)} \quad (2b)$$

wherein $V_{output}$ represents the output grayscale value of the pixel, $V_0$ represents the input grayscale value of the pixel, $bl_{psf}$ represents the backlight signal value of the pixel, a is a constant greater than 1, for example, 1.2 may be selected, and the smaller the value of a, the better, for example, $\gamma=2.2$, and M represents the always-on grayscale value, which is generally 255.

In addition, the output grayscale value of the pixel may be determined according to the following formula 3b:

$$V_{output}=((M-T\times(M+(bl_{psf}-M)/a)/bl_{psf})^{(1/\gamma)})/(M-T))\times(V_0-M)+M \quad (3b)$$

wherein $V_{output}$ represents the output grayscale value of the pixel, $V_0$ represents the input grayscale value of the pixel, $bl_{psf}$ represents the backlight signal value of the pixel, T represents the peak stretching threshold, a is a constant greater than 1, for example, 1.2 may be selected, and the smaller the value of a, the better, for example, $\gamma=2.2$, and M represents the always-on grayscale value, which is generally 255.

The above formula 3b is a straight line solving expression based on the formula 2a. The formula 2b has two main improvements over the formula 2a: the point P is moved in the upward direction by changing the original backlight signal value; and adding a power index of $1/\gamma$, which makes the transmittance curve smooth at the point P, makes change in the transmittance softer, and achieves a better display effect. Therefore, the black spot problem may be solved, which realizes a better HDR display effect.

Figure 8A:
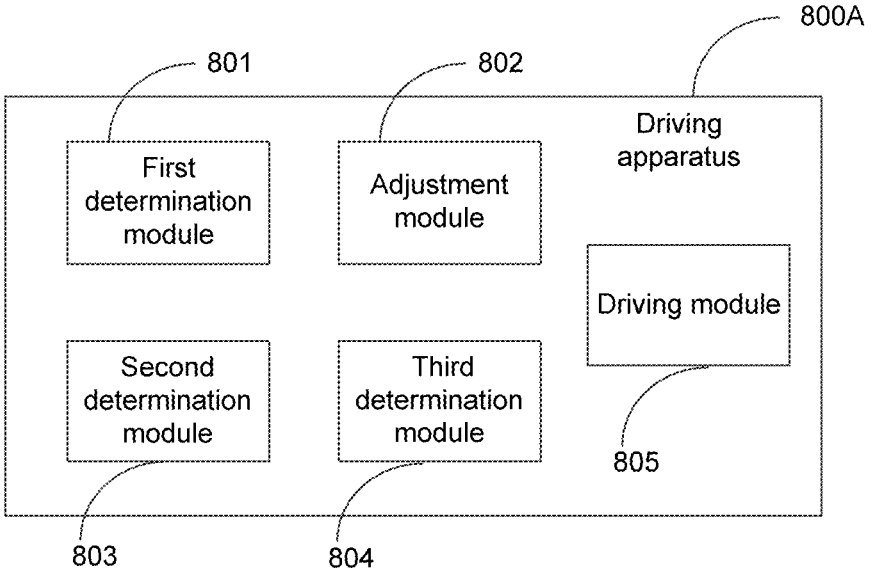
FIG. 8A illustrates a schematic structural diagram of a driving apparatus according to an embodiment of the present disclosure.

FIG. 8A illustrates a schematic structural diagram of a driving apparatus according to an embodiment of the present disclosure. As shown in FIG. 8A, the driving apparatus 800A according to the embodiment of the present disclosure may comprise a first determination module 801 configured to determine backlight signal values of a plurality of backlight partitions in a backlight module according to input grayscale values of pixels in an image to be displayed. The driving apparatus 800A may further comprise an adjustment module 802 configured to adjust the backlight signal values of the plurality of backlight partitions by performing peak stretching processing on at least one of the plurality of backlight partitions having a backlight signal value greater than a peak stretching threshold, so that a total power consumption of the plurality of backlight partitions in the backlight module is less than a power threshold of the backlight module. The driving apparatus 800A may further comprise a second determination module 803 configured to determine backlight signal values of the pixels in the image to be displayed. The driving apparatus 800A may further comprise a third determination module 804 configured to determine output grayscale values of the pixels according to the backlight signal values of the pixels and the input grayscale values of the pixels. The driving apparatus 800A may further comprise a driving module 805 configured to drive a display panel to display the image to be displayed using the determined output grayscale values of the pixels, and drive the backlight module using the adjusted backlight signal values of the plurality of backlight partitions.

It may be understood by those skilled in the art that functional modules in the driving apparatus 800A according to the embodiment of the present disclosure may be used to implement various functions of the exemplary driving method according to the embodiment of the present disclosure, for example, the driving methods described above with reference to FIGS. 3 to 7B, which will not be repeat here for brevity.

Figure 8B:
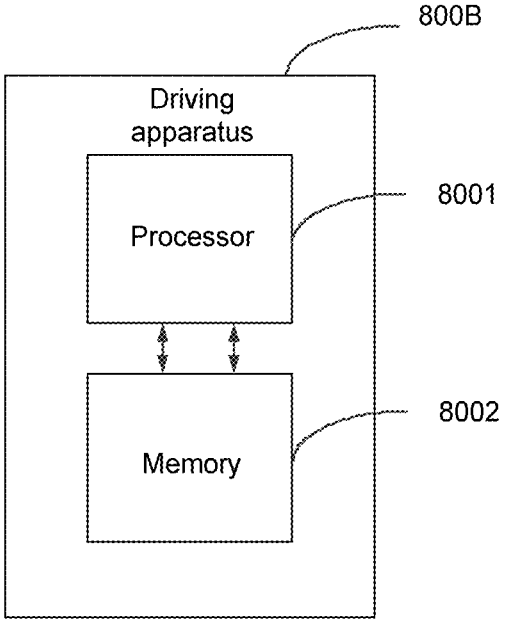
FIG. 8B illustrates a schematic structural diagram of a driving apparatus according to another embodiment of the present disclosure.

FIG. 8B illustrates a schematic structural diagram of a driving apparatus according to another embodiment of the present disclosure. As shown in FIG. 8B, the driving apparatus 800B according to the embodiment of the present disclosure may comprise: at least one processor 8001; and a memory 8002. The memory 8002 may have instructions stored therein. The at least one processor 8001 executes the instructions stored in the memory 8002 to implement the driving method according to the embodiment of the present disclosure.

It may be understood by those skilled in the art that by executing the instructions stored in the memory 8002 by the processor 8001, the driving apparatus 800B according to the embodiment of the present disclosure may implement various functions of the exemplary driving method according to the embodiment of the present disclosure, for example, the driving methods described above with reference to FIGS. 3 to 7B, which will not be repeat here for brevity.

Figure 9:
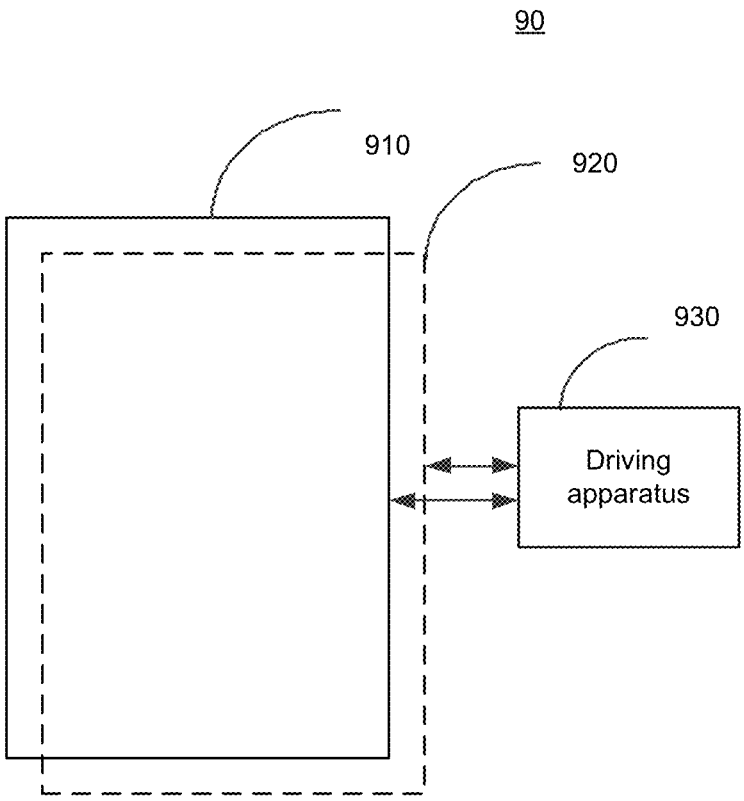
FIG. 9 illustrates a schematic structural diagram of a display device according to an embodiment of the present disclosure.

FIG. 9 illustrates a schematic structural diagram of a display device according to an embodiment of the present disclosure. As shown in FIG. 9, a display device 90 according to an embodiment of the present disclosure may comprise a display panel 910, a backlight module 920, and a driving apparatus 930. The driving apparatus 930 may be, for example, the driving apparatus according to the embodiment shown in FIG. 8A, or may be the driving apparatus according to the embodiment shown in FIG. 8B.

It may be understood by those skilled in the art that the display device 90 according to the embodiment of the present disclosure may be any product or component having a display function, such as an electronic paper, a mobile phone, a tablet computer, a television, a display, a notebook computer, a digital photo frame, a navigator, etc.

According to the technical solutions of the embodiments of the present disclosure, there are provided a display device and a method for driving the same, a driving apparatus, and a computer-readable medium. Peak stretching processing is performed on the backlight signal value of at least one of the plurality of backlight partitions using a cumulative distribution function to adjust the backlight signal values of the plurality of backlight partitions, and smooth processing is performed on the backlight partitions which have been subjected to the peak stretching processing to obtain the backlight signal values of the respective pixels in the image to be displayed, which may further improve the display effect. In addition, the output grayscale value of each pixel is determined according to the backlight signal value and the input grayscale value of the pixel for display control. In addition, in a case where a backlight partition of a backlight module may correspond to a number of pixels which is not an integer, integerization processing is performed. With the technical solutions according to the embodiments of the present disclosure, the backlight signal value may be accurately compensated in a case of any change in backlight, so that the adjusted transmittance matches with the change in backlight and the brightness of the image to be displayed, thereby avoiding the bright block problem and improving the display effect.

It should be illustrated that, functions described herein as being implemented by pure hardware, pure software, and/or firmware may also be implemented by means of dedicated hardware, a combination of general-purpose hardware and software, etc. For example, functions described as being implemented by dedicated hardware (for example, Field Programmable Gate Array (FPGA), Application Specific Integrated Circuit (ASIC), etc.) may be implemented by a combination of general purpose hardware (for example, Central Processing Unit (CPU), or Digital Signal Processor (DSP)) and software, and vice versa.

It should be illustrated that, in the above description, the technical solutions according to the embodiments of the present disclosure are shown by way of example only, but it does not mean that the embodiments of the present disclosure are limited to the above steps and structures. Where possible, steps and structures may be adjusted and selected as needed. Therefore, some steps and units are not necessary to implement the general idea of the embodiments of the present disclosure.

The present disclosure has been described hereto in connection with the embodiments. It should be understood that various other changes, substitutions and additions can be made by those skilled in the art without departing from the spirit and scope of the embodiments of the present disclosure. Therefore, the scope of the embodiments of the present disclosure is not limited to the specific embodiments described above, but is defined by the appended claims.

We claim:

1. A method for driving a display device comprising a display panel and a backlight module, the method comprising:

determining backlight signal values of a plurality of backlight partitions in the backlight module according to input grayscale values of pixels in an image to be displayed;

adjusting the backlight signal values of the plurality of backlight partitions by performing peak stretching processing on at least one of the plurality of backlight partitions having a backlight signal value greater than a peak stretching threshold, so that a total power consumption of the plurality of backlight partitions in the backlight module is less than a power threshold of the backlight module;

determining backlight signal values of the pixels in the image to be displayed according to the adjusted backlight signal values of the plurality of backlight partitions;

determining output grayscale values of the pixels according to the backlight signal values of the pixels and the input grayscale values of the pixels;

driving the display panel using the determined output grayscale values of the pixels; and driving the backlight module using the adjusted backlight signal values of the plurality of backlight partitions.

2. The method according to claim 1, wherein the adjusting the backlight signal values of the plurality of backlight partitions by performing peak stretching processing on at least one backlight partition having a backlight signal value greater than a peak stretching threshold comprises:

determining a maximum power consumption margin of the backlight module according to the backlight signal values of the plurality of backlight partitions and the power threshold of the backlight module;

calculating, for each of the plurality of backlight partitions, a representative backlight value of the backlight partition based on a cumulative distribution function of input grayscale values of pixels in a sub-display region corresponding to the backlight partition, so as to obtain a plurality of representative backlight values;

ranking candidate ones of the plurality of backlight partitions having a representative backlight value greater than the peak stretching threshold in a descending order of the plurality of representative backlight values; and sequentially stretching the backlight signal values of the ranked candidate backlight partitions in response to a sum of power consumption increments of the backlight module due to the peak stretching processing being less than the maximum power consumption margin.

3. The method according to claim 2, wherein the calculating a representative backlight value of the backlight partition based on a cumulative distribution function of input grayscale values of pixels in a sub-display region corresponding to the backlight partition comprises:

performing histogram statistics on the input grayscale values of the pixels in the sub-display region to obtain a histogram reflecting a number of pixels as a function of the input grayscale values; and calculating the representative backlight value of the backlight partition using the cumulative distribution function of the input grayscale values according to the histogram.

4. The method according to claim 1, wherein the determining backlight signal values of the pixels in the image to be displayed comprises:

determining the backlight signal values of the pixels in the image to be displayed by processing the adjusted backlight signal values of the plurality of backlight partitions using a preset backlight diffusion function.

5. The method according to claim 1, further comprising:

performing smoothing processing on the backlight signal values of the backlight partitions which have been subjected to the peak stretching processing, wherein determining backlight signal values of the pixels in the image to be displayed comprises:

determining the backlight signal values of the pixels in the image to be displayed by processing the smoothed backlight signal values using a preset backlight diffusion function.

6. The method according to claim 5, wherein performing smoothing processing on the backlight signal values of the backlight partitions which have been subjected to the peak stretching processing comprises:

acquiring a backlight signal value A of a backlight partition $SB_{peak}$ which has been subjected to the peak stretching processing;

acquiring a minimum value B of backlight signal values of (N×N−1) neighborhood backlight partitions of the backlight partition $SB_{peak}$, where N is an odd number greater than 1; and in response to a difference value (A−B) being greater than or equal to a smoothing threshold K, using a smoothed backlight signal value $A'=(K/(A-B))\times A+(1-K/(A-B))\times B$ as the backlight signal value of the backlight partition $SB_{peak}$.

7. The method according to claim 1, wherein the determining backlight signal values of a plurality of backlight partitions in the backlight module according to input grayscale values of pixels in an image to be displayed comprises:

for each of the plurality of backlight partitions, performing histogram statistics on input grayscale values of a sub-display region corresponding to the backlight partition to obtain a histogram reflecting a number of pixels as a function of the input grayscale values; and calculating a backlight signal value of the backlight partition using a cumulative distribution function of the input grayscale values according to the histogram, wherein performing histogram statistics on input grayscale values of a sub-display region corresponding to the backlight partition comprises:

determining a percentage r of pixel area of a row or column of boundary pixels between a sub-display region $SA_i$ of a backlight partition $SB_i$ and a sub-display region $SA_j$ of a backlight partition $SB_j$ located within the sub-display region $SA_i$, where $0<r<1$, i and j are integers, $1\leq i\leq l$, $1\leq j\leq l$, l is a number of the plurality of backlight partitions in the backlight module, and the backlight partition $SB_i$ and the backlight partition $SB_j$ are adjacent ones of the plurality of backlight partitions; and performing histogram statistics on input grayscale values of pixels in the sub-display region $SA_i$ based on the percentage r pixel area.

8. The method according to claim 1, wherein the power threshold of the backlight module is set to a rated power of the backlight module or a maximum power withstandable by the backlight module.

9. A non-transitory computer-readable storage medium having stored thereon instructions that are configured to, when executed by at least one processor, implement the method according to claim 1.

10. A driving apparatus, comprising:

a memory configured to store instructions;

at least one processor which executes the instructions stored in the memory to:

determine backlight signal values of a plurality of backlight partitions in the backlight module according to input grayscale values of pixels in an image to be displayed;

adjust the backlight signal values of the plurality of backlight partitions by performing peak stretching processing on at least one of the plurality of backlight partitions having a backlight signal value greater than a peak stretching threshold, so that a total power consumption of the plurality of backlight partitions in the backlight module is less than a power threshold of the backlight module;

determine backlight signal values of the pixels in the image to be displayed according to the adjusted backlight signal values of the plurality of backlight partitions;

determine output grayscale values of the pixels according to the backlight signal values of the pixels and the input grayscale values of the pixels;

drive the display panel using the determined output grayscale values of the pixels; and drive the backlight module using the adjusted backlight signal values of the plurality of backlight partitions.

11. A display device, comprising:

a display panel comprising a plurality of sub-display regions;

a backlight module comprising a plurality of backlight partitions; and the driving apparatus according to claim 10.

12. The driving apparatus according to claim 10, wherein the at least one processor executes the instructions stored in the memory to:

determine a maximum power consumption margin of the backlight module according to the backlight signal values of the plurality of backlight partitions and the power threshold of the backlight module;

calculate, for each of the plurality of backlight partitions, a representative backlight value of the backlight partition based on a cumulative distribution function of input grayscale values of pixels in a sub-display region corresponding to the backlight partition, so as to obtain a plurality of representative backlight values;

rank candidate ones of the plurality of backlight partitions having a representative backlight value greater than the peak stretching threshold in a descending order of the plurality of representative backlight values; and sequentially stretch the backlight signal values of the ranked candidate backlight partitions in response to a sum of power consumption increments of the backlight module due to the peak stretching processing being less than the maximum power consumption margin.

13. The driving apparatus according to claim 10, wherein the at least one processor executes the instructions stored in the memory to:

perform histogram statistics on the input grayscale values of the pixels in the sub-display region to obtain a histogram reflecting a number of pixels as a function of the input grayscale values; and calculate the representative backlight value of the backlight partition using the cumulative distribution function of the input grayscale values according to the histogram.

14. The driving apparatus according to claim 10, wherein the at least one processor executes the instructions stored in the memory to:

determine the backlight signal values of the pixels in the image to be displayed by processing the adjusted backlight signal values of the plurality of backlight partitions using a preset backlight diffusion function.

15. The driving apparatus according to claim 10, wherein the at least one processor executes the instructions stored in the memory to:

perform smoothing processing on the backlight signal values of the backlight partitions which have been subjected to the peak stretching processing, and determine the backlight signal values of the pixels in the image to be displayed by processing the smoothed backlight signal values using a preset backlight diffusion function.

16. The driving apparatus according to claim 10, wherein the at least one processor executes the instructions stored in the memory to:

acquire a backlight signal value A of a backlight partition $SB_{peak}$ which has been subjected to the peak stretching processing;

acquiring a minimum value B of backlight signal values of $(N\times N-1)$ neighborhood backlight partitions of the backlight partition $SB_{peak}$, where N is an odd number greater than 1; and in response to a difference value $(A-B)$ being greater than or equal to a smoothing threshold K, use a smoothed backlight signal value $A'=(K/(A-B))\times A+(1-K/(A-B))\times B$ as the backlight signal value of the backlight partition $SB_{peak}$.

17. The driving apparatus according to claim 10, wherein the at least one processor executes the instructions stored in the memory to:

for each of the plurality of backlight partitions, perform histogram statistics on input grayscale values of a sub-display region corresponding to the backlight partition to obtain a histogram reflecting a number of pixels as a function of the input grayscale values; and calculate a backlight signal value of the backlight partition using a cumulative distribution function of the input grayscale values according to the histogram, and determine a percentage r of pixel area of a row or column of boundary pixels between a sub-display region $SA_i$ of a backlight partition $SB_i$ and a sub-display region $SA_j$ of a backlight partition $SB_j$ located within the sub-display region $SA_i$, where $0<r<1$, i and j are integers, $1 \leq i \leq l$, $1 \leq j \leq l$, l is a number of the plurality of backlight partitions in the backlight module, and the backlight partition $SB_i$ and the backlight partition $SB_j$ are adjacent ones of the plurality of backlight partitions; and perform histogram statistics on input grayscale values of pixels in the sub-display region $SA_i$ based on the percentage r pixel area.

* * * * *